United States Patent [19]

Filip

[11] 3,999,731

[45] Dec. 28, 1976

[54] ADJUSTABLE HOLDER FOR NURSING BOTTLE

[76] Inventor: Alexandru Dan Filip, 1511 Cedar Cove, La Porte, Tex. 77571

[22] Filed: July 17, 1975

[21] Appl. No.: 596,807

[52] U.S. Cl. ..... 248/107

[51] Int. Cl.[2] ..... A47D 15/00

[58] Field of Search ..... 248/102, 103, 104, 105, 248/106, 107, 122, 124, 181

[56] References Cited

UNITED STATES PATENTS

| | | | |
|---|---|---|---|
| 1,280,013 | 9/1918 | Goddard | 248/181 |
| 1,608,795 | 11/1926 | Kennedy | 248/181 |
| 2,386,042 | 10/1945 | Elzeer | 248/106 |
| 2,650,788 | 9/1953 | Hulstein | 248/181 |
| 2,717,753 | 9/1955 | Schweikert | 248/106 |
| 2,828,097 | 3/1958 | Faunce | 248/106 |
| 2,909,345 | 10/1959 | Matsuoka | 248/106 |
| 3,028,133 | 4/1962 | Craig | 248/106 |
| 3,519,231 | 7/1970 | Miller | 248/106 |

*Primary Examiner*—Robert A. Hafer

[57] ABSTRACT

An adjustable holder apparatus for a nursing bottle comprising a base assembly, a supporting structure mounted on the base assembly and generally vertically adjustable with respect to the base assembly, and bottle gripping means mounted on the supporting structure for vertical movement therewith. The bottle gripping means is also mounted for pivotal movement with respect to the supporting structure in three mutually perpendicular directions.

15 Claims, 4 Drawing Figures

FIG. 1
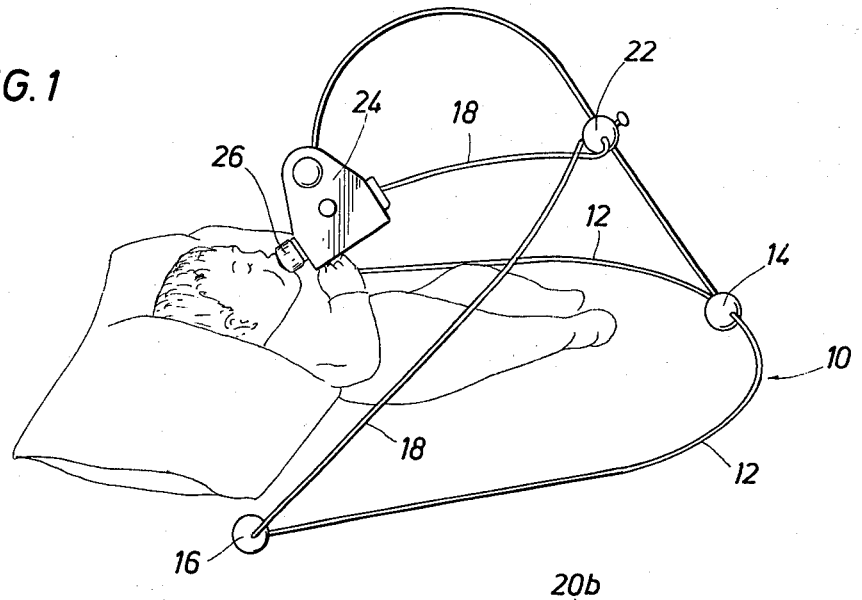
FIG. 2
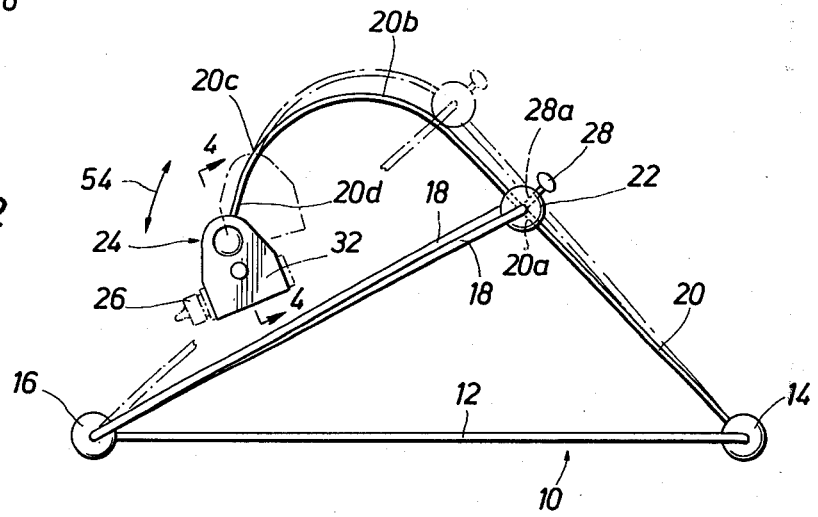
FIG. 3
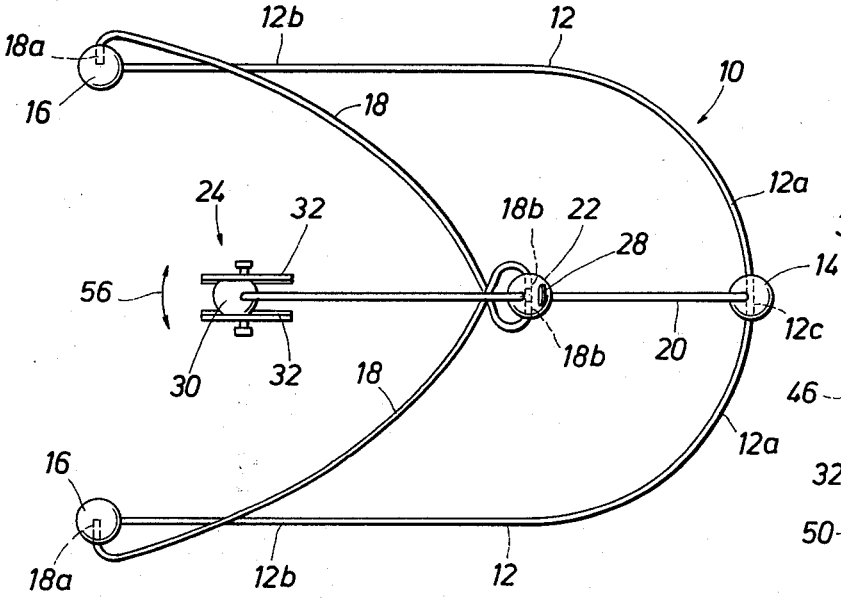
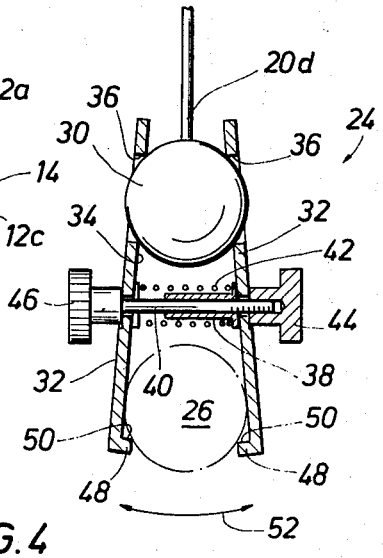
FIG. 4

ADJUSTABLE HOLDER FOR NURSING BOTTLE

BACKGROUND OF THE INVENTION

1. Field of the Invention

The present invention pertains to an apparatus for holding a nursing bottle for an infant.

It is highly desirable when bottle feeding an infant to hold both the child and the bottle, particularly if the child is very young. This is important, not only because the infant is incapable of supporting and controlling the bottle by himself, but also for the psychological comfort of the child and satisfaction of the parent. However, as every parent well knows, there are times when other pressing duties make this virtually impossible so that feeding of the infant must either be delayed or interrupted to the irritation of both parent and child. Furthermore, as the infant begins to mature, his psychological need to be held during feeding decreases. At the same time the child gains increasing strength and dexterity of the head, neck, hands, arms, etc. so that he becomes capable of at least partially controlling the nursing bottle though still incapable of firmly gripping and supporting it. At this age the child enjoys trying to grasp and manipulate the bottle and such activity helps to improve his motor skills, but unless some auxiliary support is provided, he is likely to drop the bottle out of his own reach and possibly spill the milk or injure himself. Accordingly, it is highly desirable that a safe and practical holder apparatus be provided to allow an infant to nurse itself.

2. Description of the Prior Art

In the past, various devices have been devised for holding nursing bottles. However, none of these have been entirely satisfactory. One problem with these prior art holders is that they have not provided for adequate angular adjustment of the bottle position. One such device is shown in U.S. Pat. No. 3,028,133 to Craig. In this device the bottle is vertically adjustable and angularly pivotable but only in the vertical direction. Thus, the device does not provide for sufficient universal movement of the bottle to accommodate the stirring of an active baby. Even if the baby is quiet, it is highly desirable that the bottle be angularly adjustable in three mutually perpendicular directions so that the nipple can be comfortably positioned in the baby's mouth regardless of the position of his head.

In other devices, such as those shown in U.S. Pat. Nos. 1,629,156 and 2,828,097, the bottle swings freely on one or more chains, elastic straps, or the like. This arrangement allows a more universal type of movement but is unacceptable in that there is too much freedom of movement, or in other words, insufficient control of the movement. A slight movement of the bottle by the baby can send the bottle swinging and/or bouncing about so that the child cannot catch it and may even be injured by it. Furthermore, the bottle always tends to swing back to its undisturbed position. The baby will not usually be strong enough to maintain the bottle in a different angular position than this undisturbed position for any length of time, and the bottle cannot, if desired, be fixed at a given angle other than the undisturbed position. Finally, these devices fail to provide for vertical adjustment of the height of the bottle.

U.S. Pat. No. 2,909,345 to Matsuoka shows a device which supports the bottle on a flexible wire, which allows it to bounce, but does not provide for angular adjustment during nursing.

Another problem with many of the prior art devices is that their bases have not provided sufficiently stable support rendering them impractical and even dangerous. Some of them include bases which rest on the bed, floor, etc. beside the baby and bottle support means which extend from the base in cantilever fashion with no other auxiliary support. In some instances, supporting parts are within reach of the baby's hands or feet. In the Matsuoka device, the stability of the device depends upon the weight of the baby's body which is placed upon the base, a highly undesirable situation. Some designers have attempted to circumvent this problem by suspending the bottle holder from the infant's crib, but this makes the holder much less versatile.

SUMMARY OF THE INVENTION

The present invention provides a holder apparatus for a nursing bottle having a base assembly, a supporting structure mounted on the base assembly, and bottle gripping means mounted on the supporting structure. The supporting structure along with the attached bottle gripping means is vertically adjustable with respect to the base assembly, while the bottle gripping means itself is pivotable with respect to the supporting structure in three mutually perpendicular directions. Thus the apparatus provides not only for adjustment of the height of the bottle but also for universal-type movement of the bottle.

In the preferred embodiments, the bottle gripping means is suspended from a generally downwardly depending part of the supporting structure. This part may be flexible and resilient under bending forces, but, unlike the prior art chains, elastic bands, etc., is substantially inflexible under non-bending tensile and compressive forces. Thus the apparatus combines substantial freedom of movement of the bottle with sufficient control to allow successful manipulation of the bottle by the nursing child.

The apparatus is preferably provided with angular lock means for fixing the bottle gripping means in a desired angular position with respect to the supporting structure as may be desired in feeding a very young or quiet infant.

The support structure preferably comprises three arms each having a base end vertically pivotally mounted on the base assembly. The base ends are spaced apart on the base assembly as the spaces of a triangle and the arms extend upwardly therefrom and meet to define a pyramid-type structure. This provides great stability and safety while still leaving the apparatus versatile enough to be portable and conveniently used in various locations such as the infant's crib, on the floor, etc.

Accordingly, it is a principle object of the present invention to provide an improved holder apparatus for a nursing bottle.

Another object of the invention is to provide a nursing bottle holder apparatus providing for both vertical adjustment and universal-type pivotal movement of the bottle.

Still another object of the invention is to provide a nursing bottle holder apparatus which is safe and stable yet versatile and portable.

Yet a further object of the invention is to provide a nursing bottle holder apparatus which allows universal-type movement of the bottle yet provides sufficient control of this movement to allow successful manipulation of the bottle by an infant.

Another object of the invention is to provide a nursing bottle holder apparatus in which the bottle can be angularly adjusted and then fixed in a desired angular position.

Still other objects, features, and advantages of the present invention will be made apparent by the following detailed description of a preferred embodiment, the drawings, and the claims.

BRIEF DESCRIPTION OF THE DRAWINGS

FIG. 1 is a perspective view of a preferred embodiment of the invention in use in nursing an infant.

FIG. 2 is a side elevational view of the holder apparatus of FIG. 1.

FIG. 3 is a top plan view of the holder apparatus of FIGS. 1 and 2.

FIG. 4 is a sectional view along lines 4—4 of FIG. 2 showing the bottle gripping means and its mounting.

DESCRIPTION OF THE PREFERRED EMBODIMENT

Referring now to the drawings, the holder apparatus comprises a bifurcated, and more specifically, a generally U-shaped base assembly 10. The base assembly 10 comprises two elongated base elements 12 having parallel generally, straight leg sections **12*b* which form the legs of the U and converging curved loop sections 12*a* which are joined by a connector 14 to form the loop of the U. The loop of the U generally comprises a juncture portion and the legs of the U generally comprise an open portion of the bifurcated base assembly 10. A connector 16 is disposed at the end of each of the sections 12*b* as shown. For descriptive purposes herein, the direction from the juncture portion to the open portion of the base assembly generally parallel to sections 12*b* will be considered the length of the base assembly 10, and the transverse direction from one section 12*b* to the other will be considered the width of the base assembly 10.** Also, "vertical pivotal movement" will refer to movement generally in a vertical plane.

Mounted on the base assembly 10 is a supporting structure comprising three arms 18 and 20, each of which has a base end mounted in a respective one of the connectors 14, 16. Arm 20 is the support arm and has its base end mounted in connector 14 in the juncture portion of the base assembly 10. Arms 18 are the suspension arms and each has its base end mounted in a respective one of the connectors 16. It will be appreciated that the connectors 16 are spaced from connector 14 in one direction (lengthwise) on the base assembly, and from each other in a transverse direction (across the width) on the base assembly. Thus, the connectors and their respective base ends are spaced generally upwardly and toward one another to meet in a suspension connector 22 to form a structure having a pyramid-type profile. Suspension connector 22 is located generally above the central portion of the area bounded by the base assembly 10. This pyramid-type structure with its upper apex generally centered with respect to its base provides great stability to the holder apparatus to prevent it from falling or being knocked over. Furthermore, even when the supporting structure is adjusted to its greatest height as will be explained more fully below, the height of the pyramid is less than the length of the base assembly and not substantially greater than the width of the base assembly; this further enhances the stability of the device.

As best seen in FIG. 3, the converging ends of the loop sections **12*a* of base elements 12 are rotatably disposed in a bore in connector 14 transverse to the base end of the support arm 20 as indicated at 12*c*. Thus support arm 20 can pivot vertically with respect to the base assembly as connector 14 rotates on the ends of loop sections 14*a*. The base ends of the suspension arms 18 are turned in toward each other and rotatably disposed in bores in their respective connectors 16 transverse to the ends of the leg sections 12*b* as indicated at 18*a*. Thus the suspension arms 18 can pivot vertically with respect to the base assembly as their base ends rotate in the connectors 16.**

Suspension arms 18 cross just below the suspension connector 22, then their upper or swinging ends turn in toward each other and are rotatably disposed in a bore in the suspension connector 22 as indicated at **18*b*. It will be appreciated that the arm ends 12*c*, 18*a*, and 18*b* and the bores in which they are disposed are all positioned generally crosswise of the base assembly to permit the vertical pivoting of the arms 18 and 20, generally in planes having substantial lengthwise components of direction with respect to base 10.**

The intermediate portion of support arm 20 extends slidably through a bore in suspension connector 22 transverse to the swinging ends **18*b* of the suspension arms as indicated at 20*a* in FIG. 2. This latter bore serves as a slideway for the arm 20. Upwardly of the suspension connector 22, arm 20 has a generally arcuate portion 20*b* having a generally downwardly directed part 20*c* including the free end 20*d* of the support arm 20. Bottle gripping means 24, to be described more fully below, is connected to free end 20*d* whereby it is suspended from downwardly directed part 20*c*.**

It will be appreciated that the pivotal mountings of ends **12*c*, 18*c*, and 18*b*, and the slidable mounting of arm 20 in suspension connector 22 allow vertical adjustment of the entire supporting structure and with it the bottle gripping means 24. The supporting structure and bottle gripping means is shown in a lower position in solid lines in FIG. 2. By sliding the suspension connector 22 upwardly along the arm 20 the supporting structure and bottle gripping means can be moved vertically upwardly, for example, to the position shown in phantom lines. The supporting structure and bottle grippings means can also be moved vertically downwardly by sliding the suspension connector 22 in the opposite direction on arm 20. The pivotal connections 12*c*, 18*a*, and 18*b* permit the proper movement of the arms 18 and 20 as the suspension connector is moved. In this manner the holder apparatus is readily adjusted to place the bottle 26** at a comfortable height for the baby depending upon his size, whether or not his head is resting on a pillow, etc.

Once the supporting structure has been adjusted to the desired height, it is releasably locked in place by means of a vertical lock in the form of a thumb screw 28 having its pin portion extending through a threaded bore in connector 22 which is transverse to and intersects the slideway for the arm 20.

It will be appreciated that when an infant is placed generally between the leg sections **12*b* of the base 10 with his feet toward the loop sections 12*a*, the bottle 26 is easily accessible to him while the base portions 12 and arms 18 and 20 are usually out of his reach. The curvature of the sections 12*a*** to form a U rather than a V shape helps to keep the juncture portion of the base out of reach of the infant's feet. The arcuate portion 20*b* similarly keeps arm 20 out of the infant's reach while still providing access to the bottle. The arms 18 may also be curved in a manner, as best seen in FIG. 3, to help keep these latter arms out of reach of the baby's hands. While the apparatus is stable enough to prevent a small infant from turning it over, the arrangement described above provides an additional safety measure. Furthermore, this arrangement prevents the child from pushing the apparatus sideways and thus moving the bottle out of his own reach. These features can be enhanced by weighting the base as, for example, at the connectors 14 and 16.

The base portions 12 and the arms 18 and 20 are preferably formed of heavy gauge wire. The wire of arm 20 is substantially inflexible under non-bending compressive and tensile forces of the order of magnitude which a human being might impose on the wire. Yet, it is somewhat flexible and resilient under bending forces. Thus, in particular, the curve 20*b* can flex slightly to accommodate movements of the nursing infant, yet it will not allow inconvenient and dangerous free swinging and bouncing movements of the bottle 26. The degree of flexibility can be adjusted somewhat by moving the suspension connector 22 to vary the length of the portion of arm 20 between its free end 20*d* and the portion 20*a* engaged by the connector 22. The wires of which the various parts are formed are preferably sufficiently stiff so that, when braced against each other by the connectors 14, 16 and 22, the pyramid part of the apparatus is substantially rigid. It will be appreciated that other materials, such as plastics having the desired physical properties, could be used in place of the wires.

The supporting structure includes a ball 30 fixed on the free end 20*d* of the support arm 20. The bottle gripping means 24 includes two generally parallel plate-like gripping members 32 having respective inner surfaces 34 facing each other to grip the bottle 26 therebetween. Each of the surfaces 34 has a socket in the form of a circular aperture 36 through the gripping element 32. The gripping elements 32 are disposed on opposite sides of the ball 30 with each aperture 36 receiving a respective portion of the ball 30 to mount the gripping means 24 on the supporting structure. It will be appreciated that this ball and socket type mounting allows a universal type movement of the bottle gripping means, i.e. it allows swivelling movement in three mutually perpendicular directions as indicated by the arrows 52, 54, and 56.

One of the gripping elements has a threaded box 38 rigidly mounted thereon to extend from the respective inner surface 34. The other gripping element 32 rotatably carries a threaded pin 40 which is received in the box 38. A compression spring 42 encircles the pin 40 and box 38 between the surfaces 34 and urges these surfaces away from each other. A knurled, rotatable knob 46 connected to pin 40 is located on the outer surface of the respective gripping element 32 and a fixed knob 44 is provided on the other gripping element 32 to aid in rotating the pin 40 in the box 38. The pin 40 and box 38 comprise angular lock means which may be tightened by advancing the pin to fix the bottle gripping means and bottle at any desired angle with respect to the nursing baby. By retracting the pin to varying degrees, and thus changing the tightness of the frictional engagement of ball 30, varying degrees of freedom of swivelling movement of the bottle gripping means may be permitted as desired. In particular, it may be adjusted to provide enough freedom to permit the child to move the bottle but enough control to keep the bottle in the position to which the child moves it until he moves it again. Sufficient retraction of the pin 40 allows the bottle gripping means to be removed from the supporting structure for storage or the like. The spring 42 helps to maintain proper alignment of the surfaces 34.

It will be appreciated that the bottle is frictionally gripped by the surfaces 34. Additionally, an inwardly directed flange 48 is provided at the lower end of each surface 34 to provide respective aligned bottle supporting surfaces 50 facing generally upwardly. Resilient or cushion-like pads may also be provided on the surfaces 34 to aid in gripping the bottle. The bottle may be removed from the gripping means by retracting the pin 40.

It will be appreciated that many modifications of the preferred embodiment can be made without departing from the spirit of the invention. For example, other forms of bases could be used, and other universal-type mountings, specifically other types of ball and socket mountings, could be employed for the bottle gripping means. Accordingly, it is intended that the scope of the invention be limited only by the claims which follow.

I claim:

1. A holder apparatus for a nursing bottle comprising:

a base assembly;

a supporting structure mounted on said base assembly and generally vertically adjustable with respect to said base assembly, said supporting structure comprising a support arm having a base end mounted on said base assembly for vertical pivotal movement of said support arm with respect to said base assembly and a free end, said supporting structure further comprising suspension means for vertically adjusting said support arm with respect to said base assembly, said suspension means comprising a pair of suspension arms each having a base end mounted on said base assembly for vertical pivotal movement of said suspension arms with respect to said base assembly and a swinging end slidably and vertically pivotally connected to said support arm between the ends of said support arm for movement therealong, said base ends of said suspension arms being spaced from said base end of said support arm in a first generally horizontal direction and further being spaced from each other in a second generally horizontal direction transverse to said first direction, said suspension means further comprising releasable vertical lock means for selectively fixing said swinging ends of said suspension arms in various locations along said support arm;

and bottle gripping means mounted on said free end of said support arm for vertical movement with said supporting structure.

2. Holder apparatus as recited in claim 1 including ball and socket means mounting said bottle gripping means on said supporting structure.

3. Holder apparatus as recited in claim 2 further comprising angular lock means selectively operable to fix said bottle gripping means in a desired angular position on said ball and socket means and releasable to allow free swivelling movement of said bottle gripping means on said ball and socket means.

4. Holder apparatus as recited in claim 3 wherein said angular lock means is adjustable to vary the degree of freedom of movement of said bottle gripping means on said ball and socket means.

5. Holder apparatus as recited in claim 2 wherein said gripping means comprises a pair of generally parallel gripping members having respective inner surfaces facing each other for gripping said nursing bottle therebetween and means for moving said inner surfaces toward and away from each other.

6. Holder apparatus as recited in claim 2 wherein said supporting structure comprises a ball and wherein said gripping means comprises a pair of generally parallel gripping members having respective inner surfaces facing each other for gripping said nursing bottle therebetween, said inner surfaces being disposed generally on opposite sides of said ball and each having a socket receiving a respective portion of said ball, said gripping means further comprising means for moving said inner surfaces toward and away from each other.

7. Holder apparatus as recited in claim 6 wherein said means for moving said inner surfaces comprises a rotatable threaded pin carried by one of said gripping members and a fixed threaded box carried by the other of said gripping members and receiving said threaded pin.

8. Holder apparatus as recited in claim 6 wherein said bottle gripping means further comprises resilient means biasing said inner surfaces away from each other.

9. Holder apparatus as recited in claim 6 wherein said gripping elements include means on said inner surfaces defining respective aligned bottle supporting shoulders facing generally vertically upwardly.

10. Holder apparatus as recited in claim 1 wherein said bottle gripping means is mounted for pivotal movement with respect to said supporting structure in three mutually perpendicular directions.

11. Holder apparatus as recited in claim 1 wherein said supporting structure further comprises a suspension connector slidably and vertically pivotally connecting said swinging ends of said suspension arms to said support arm to define a structure having a pyramid-like profile with its upper apex generally centered over its base.

12. Holder apparatus as recited in claim 1 wherein said base assembly is bifurcated and comprises a juncture portion and an open portion, said base end of said support arm being connected to the juncture portion of the base with said support arm extending generally upwardly and toward the open portion, and said suspension arms being connected to respective legs of the base assembly and extending generally upwardly, toward the juncture portion, and toward each other.

13. Holder apparatus as recited in claim 1 wherein the swinging ends of said suspension arms are joined by a suspension connector, said suspension connector having a slideway receiving said support arm, and said vertical lock means comprising a releasable pin member for fixing said support arm in said slideway.

14. Holder apparatus as recited in claim 1 wherein said support arm has a downwardly extending arcuate portion adjacent said free end whereby said bottle gripping means depends downwardly from said free end.

15. Holder apparatus as recited in claim 14 wherein said arcuate portion is flexible and resilient under bending forces but substantially inflexible under non-bending tensile and compressive forces.

* * * * *

UNITED STATES PATENT OFFICE

CERTIFICATE OF CORRECTION

Patent No. 3,999,731 Dated December 28, 1976

Inventor(s) Alexandru Dan Filip

It is certified that error appears in the above-identified patent and that said Letters Patent are hereby corrected as shown below:

In Column 2, line 47, delete the word "spaces" and insert therefor -- apeces --

In Column 4, line 36, delete "18c" and insert therefor --18a--.

Signed and Sealed this

Fourteenth Day of June 1977

[SEAL]

*Attest:*

RUTH C. MASON
*Attesting Officer*

C. MARSHALL DANN
*Commissioner of Patents and Trademarks*